US005345901A

United States Patent [19]

Siegenthaler et al.

[11] Patent Number: 5,345,901

[45] Date of Patent: Sep. 13, 1994

[54] STARTER MOTOR PROTECTION SYSTEM

[75] Inventors: David R. Siegenthaler, Verona; L. Thomas Lane, Manlius; John R. Reason, Liverpool, all of N.Y.

[73] Assignee: Carrier Corporation, Syracuse, N.Y.

[21] Appl. No.: 97,143

[22] Filed: Jul. 26, 1993

[51] Int. Cl.[5] ..... F02N 11/10

[52] U.S. Cl. ..... 123/179.3; 290/38 R

[58] Field of Search ..... 123/179.3; 290/38 R

[56] References Cited

U.S. PATENT DOCUMENTS 4,947,051 8/1990 Yamamoto et al. ..... 123/179.3

*Primary Examiner*—Andrew M. Dolinar

[57] ABSTRACT

An engine starter has a plunger electromagnetically actuated by holding and attracting coils to move a pinion toward a ring gear on the engine and also to move a first movable contact on the plunger towards first and second stationary contacts to be electrically connected together by the first movable contact to electrically energize a starter motor. Completion of the circuit between the movable contact and the stationary contacts also serves to de-energize the attracting coil which may be damaged if energized for too long. Control means are provided to determine the voltages at each of the fixed contacts. The difference between the monitored voltages is determined and compared to a reference voltage differential. If the difference is not less than or equal to the reference voltage differential, the controller is programmed to know that the circuit has not been completed, and in order to avoid damage to the attracting coil and the starter, power is interrupted to the starter circuit.

3 Claims, 2 Drawing Sheets

STARTER MOTOR PROTECTION SYSTEM

BACKGROUND OF THE INVENTION

1. FIELD OF THE INVENTION

The present invention relates to a starter for an internal combustion engine, and more particularly to a system for preventing damage to the starter under certain operating conditions.

2. DESCRIPTION OF THE PRIOR ART

A well known type electric starter, for cranking an internal combustion engine, utilizes a solenoid that has a plunger which is connected to a pinion by a shift lever. A typical prior art starter of this type is shown and described in U.S. Pat. No. 4,674,344, "Engine Starter". When the coils of the solenoid are energized the plunger is shifted to cause the pinion to mesh with the ring gear of the engine. Movement of the plunger also causes a moveable contact to engage stationary contacts of a solenoid switch to energize the electric cranking motor and thereby rotatably drive the pinion.

In some starters the starter solenoid incorporates a two coil design to engage the starter pinion gear into the engine fly wheel ring gear for engaging the starter motor. In such an arrangement the solenoid coils may typically be referred to as the "attracting" and "holding" coils. The attracting and holding coils are simultaneously energized, with the attracting coil being sized and designed to exert a high magnetic force on the starter solenoid contactor arm to pull the pinion gear into engagement with the ring gear. In one known design the attracting coil requires a high current of approximately 35 amps and is only designed to be energized for a brief period of time (typically less than one second) to engage the pinion and ring gear. Once engagement of the pinion gear is achieved, the attracting coil is de-energized, and a separate holding coil remains energized to hold the pinion gear engaged with the ring gear. The lower output force holding coil exerts only enough force to hold the gears engaged and is designed to be engaged for longer periods of time. Typically, the holding coil draws approximately six to seven amps of current.

When the plunger is successfully shifted to cause the pinion to mesh with the ring gear, a fixed contact carried by the plunger closes a set of fixed contacts to thereby energize the cranking motor and the starter drive turns over the internal combustion engine. Successful engagement of the fixed contacts by the plunger contact also serves to deactivate the attracting coil.

In certain circumstances, usually when insufficient battery voltage is applied to the starter solenoid, the pinion gear and the ring gear do not fully engage. When this occurs, the moveable contact carried by the plunger does not engage the fixed contacts and the attracting coil remains energized as long as the starter solenoid is energized. As a result, the attracting coil and the starter may fail due to overheating of the windings caused by the high current flow therethrough.

SUMMARY OF THE INVENTION

It is an object of the present invention to avoid extended damaging energization of the attracting coil in a starter solenoid.

It is another object of the invention to detect when the starter solenoid fails to cause full engagement of a pinion gear with a ring gear and to deactivate the solenoid when such condition exists.

These and other objects of the present invention are carried out by providing a starter for an internal combustion engine of the type having a ring gear. The starter includes a starter switch operable between an open and closed condition which is adapted to be electrically connected to a source of electrical power. A starter solenoid includes a pinion adapted to be axially moveable into and out of meshing engagement with the ring gear. A plunger is provided for moving the pinion toward the ring gear. The plunger has a movable contact at one end which is adapted to engage first and second stationary contacts. The first stationary contact is electrically connected to the electrical power source. An exciting coil is provided for moving the plunger towards the stationary contacts. The exciting coil includes a holding coil and an attracting coil. The holding and attracting coils have windings electrically connected in series with one another and have a connection coupled thereto at respective one ends of the coils. A relay is provided which includes a pair of normally open contacts which are connected in series to the electrical power source and the connection which couples the windings of the holding and attracting coils. The relay also includes a relay coil electrically connected in series to the starter switch and the other end of the holding coil. The relay coil is energized when the starter switch is turned on to thereby close the normally open contacts.

The starter motor is mechanically drivingly connected to the pinion. Means are provided for electrically connecting the second stationary contact to the starter motor when the starter switch is closed. As a result when the first movable contact is moved into contact with the first and second stationary contacts, the starter motor will be energized by the electrical power source. A motor controller is provided which includes means for determining the voltage at the first and second stationary contacts. Means are also provided for calculating the difference between the voltage at the first and second stationary contacts. Means are provided for comparing the calculated voltage differential to a predetermined reference voltage differential. The controller will open the starter switch to deactivate the starter if the calculated voltage differential is not less than or equal to the predetermined reference voltage differential.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein:

DETAILED DESCRIPTION OF THE PREFERRED EMBODIMENT

Figure 1:
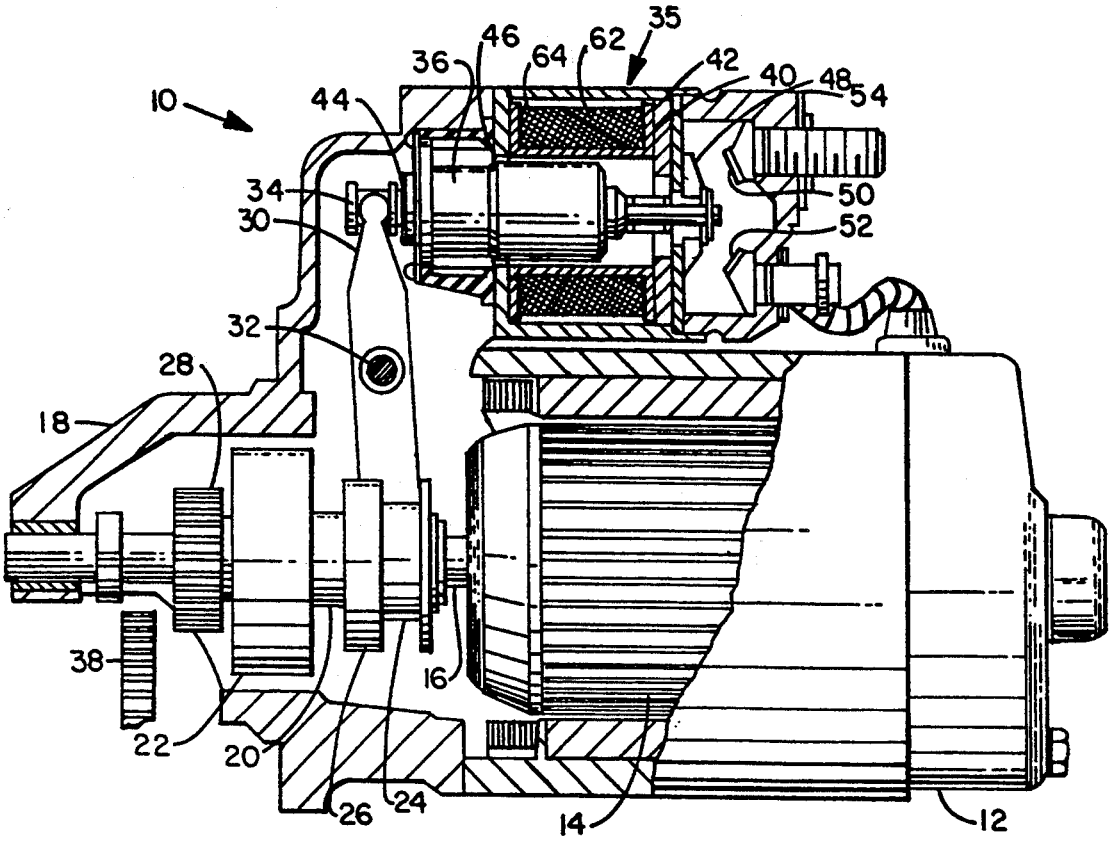
FIG. 1 is a partly sectional front elevation of a starter of the type embodying the present invention.

Referring now to FIG. 1, an engine starter 10 includes a motor 12 having an armature 14 mounted on a shaft 16 for rotation therewith. The shaft 16 is rotatably supported at one end by a motor housing and at the other end by a starter housing 18. The shaft 14 carries a spline tube 20 mounted for rotation with the shaft 16 and for axial movement with respect to the shaft 16. A unidirectional clutch 22 is mounted on the outer periphery of the spline tube 20 axially outwardly of a retainer 26 also mounted on the outer periphery surface of the spline tube 20. A pinion 28 is rotatably mounted on the shaft 16 between the end supported by the starter housing and the unidirectional clutch 22. The pinion 28 is adapted to be drivingly connected to and disconnected from the spline tube 20 by the operation of the unidirectional clutch 22.

A lever 30 is pivotally mounted by a pivot pin 32 on the starter housing 18 and has an end engaged with a joint section 34 of a plunger 36. The plunger is part of the starter solenoid 35 and will be described in more detail hereinbelow. The other end of the lever 30 is slidably engaged with an annular groove 24 in the outer peripheral surface of the retainer 26 so that, when the lever 30 is pivotally moved by the plunger 36 in a clockwise direction as viewed in FIG. 1, the spline tube 20 is axially moved on the shaft 16 to the left as viewed in FIG. 1 to bring the pinion 28 into contact with a ring gear 38 of an associated internal combustion engine (not shown) to start the operation thereof.

The solenoid plunger 36 is axially movably mounted in an annular bobbin 40 which is housed in a plunger casing 42 which in turn is mounted on the starter housing 18. The plunger 36 has an annular flange 44 adjacent to the joint section 34 of the plunger. A return spring 46 formed by a compression coil spring extends around the plunger 36 and between the flange 44 and one end of the casing 42. The end of the plunger 36 remote from the joint section 34 carries a moveable contact 48 which is moveable with the plunger 36 into and out of electrically conductive engagement with first and second stationary contacts 50 and 52 mounted on a magnetic switch casing 54 fixed to the other end of the plunger casing 42.

Figure 2:
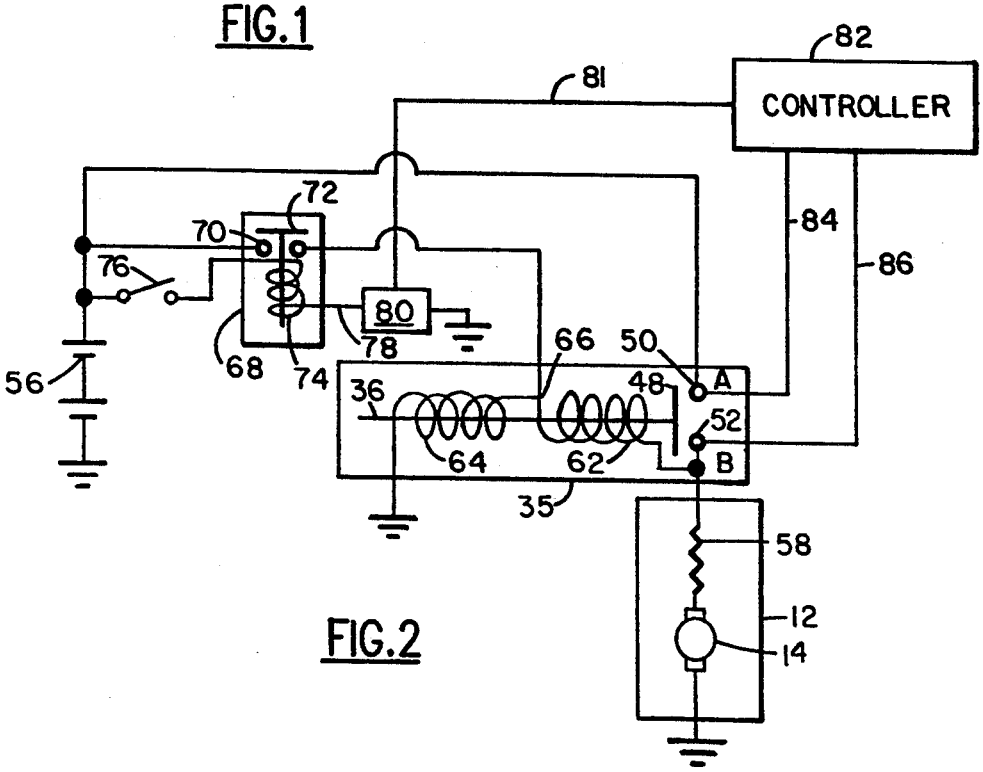
FIG. 2 is an electrical circuit diagram of a starter protection system embodying the present invention.

FIG. 2 shows the electrical circuitry of the starter 10 described above. The first stationary contact 50 is electrically connected to the positive terminal of a battery 56. The second stationary contact 52 is electrically connected through a field coil 58 to the armature 14 of the motor 12.

The solenoid 35 has an attracting coil 62 and a holding coil 64 wound on the bobbin 40 which surrounds the plunger 36. The plunger 36 is adapted to be shifted axially when the coils 62, and 64 are energized. The attracting coil 62 is electrically connected at one end to the second stationary contact 52 and to the holding coil 64 at the other end at a connection 66. The other end of the holding coil 64 is grounded.

The starter relay 68 includes a pair of normally open contacts 70, one of which is electrically connected to the positive terminal of the battery 56 and the other of which is electrically connected to the connection 66 between the attracting and holding coils 62 and 64. The relay contacts 70 are adapted to be closed when engaged by a movable contact 72 attached to the relay core and is axially movable by actuation of the starter relay coil 74. One end of the relay coil 74 is connected through a starter switch 76 to the positive terminal of the battery 56.

The other lead 78 of the relay coil is connected to the starter motor protection switch 80. The protection switch 80 is interconnected via lead 81 to the systems microprocessor controller 82.

Inputs to the controller are also provided via connections 84 and 86 which provide the controller with the capability of monitoring the voltage at the first and second stationary contacts 50 and 52 which are identified for convenience of description as points "A" and "B" respectively in the drawing. As indicated the controller 82 is a programmable microprocessor which may be programmed to operate a system in which the internal combustion engine to be started by the starter 10 is utilized.

As an example the internal combustion engine may be adapted for use in a self-contained refrigeration/heating diesel powered unit for use on insulated tractor trailers. In such an application the microprocessor 82 is capable of operating various system components in order to maintain a desired setpoint temperature for the refrigeration unit. Another automatic function provided by the controller would be an automatic start/stop feature. As the description of the invention continues it will be appreciated how the invention facilitates protection of the motor in the different operating modes of such a system. For purposes of illustration of the present invention, however, a simple start switch 76 is sufficient for a full understanding of the invention.

In operation, when the starter switch 76 is closed, the relay coil 74 is energized to move the movable contact 72 into contact with the normally open contacts 70. As a result DC current now passes through the relay to both the attracting coil 62 and the holding coil 64. When all systems are operating properly, when the coils 62 and 64 are so energized they act to move the plunger 36 and the movable contact 48 carried thereby towards the first and second stationary contacts 50 and 52. At the same time, the movement of the plunger 36 to the right as viewed in FIG. 1 pulls the upper end of the lever 30 engaged with the joint 34 of the plunger 36. As a result the lever 30 is rotated about the pivot pin 32, clockwise, to axially move the spline tube 20, the unidirectional clutch 22 and thus the pinion 28 towards the ring gear 38.

When the pinion 28 is moved into contact with the ring gear 38, a low torque rotation of the motor 12 is caused by the current passing through the attracting coil 62. This low torque rotation cooperates with the axial thrust force applied by the lever 30 to the pinion 28 to bring the pinion into meshing engagement with the ring gear 38. At the same time, the axial thrust force acts through the lever 30 on the plunger 36 to move the plunger until the movable contact 48 is brought into electrical contact with the first and second stationary contacts 50 and 52. When this connection is made two things occur: 1). DC current from the battery may then flow through the stationary contacts and the fixed contact directly to the motor 12; and 2). because the attracting coil 62 is now at the same electrical potential as the second stationary contact 52 no electrical current will pass through the attracting coil 62 for the duration of the start.

Thus, as is conventional, the armature 14 of the motor 12 rotates to forcibly rotate the shaft 16. This rotation in turn is transmitted through the spline tube 20 and the unidirectional clutch 22 to the pinion 28 which in turn engages with and drives the ring gear 38 to turn over the internal combustion engine.

Assuming all goes well, after the engine has started the starter switch 76 will be opened to interrupt the electrical supply to the relay coil 74, so that the contacts 70 of the relay are moved to their normal open position and, as a result, the electrical supply to the attracting and holding coils 62 and 64 is interrupted. Following this, the return spring 46 moves the solenoid plunger 36 and the lever 30 to their initial positions. Simultaneously, the pinion 28 is moved out of meshing engagement with the ring gear 38.

As was briefly discussed above, the starter protection system of the present invention is particularly applicable to a starter for an internal combustion engine in a refrigeration system for a transport refrigeration unit. In such a unit, the starter relay and the starter may be engaged for several reasons: (1) by the operator desiring a manual start of the refrigeration unit; (2) by an automatic start program in a microprocessor controller calling for a start to control temperature; (3) by the autostart controller sensing low battery voltage and the need to charge the battery; and (4) by coolant temperature becoming too low in an automatic start mode of operation and the controller starting the unit to keep the engine warmed for starting in cold ambients.

In any of the above circumstances, particularly when insufficient battery voltage is available to be applied to the starter solenoid, insufficient force may be available to actuate the starter mechanism and the pinion gear 28 does not fully engage the ring gear 38. When this occurs, the system attempts to mechanically actuate as described above and as a result because the solenoid plunger 36 is not able to travel through its full range of motion. When this occurs, the connection is not established between the movable contact 48 at the end of the plunger 36 and the stationary contacts 50 and 52.

Under these circumstances with power applied to the starter but the pinion and ring gear not engaged and the stationary contacts and the movable contact not engaged, as long as the starter solenoid is energized power will continue to be provided to the attracting coil 62. As a result, because the coil is not designed to be energized for any longer than a brief period of time the attracting coil 62 will fail due to overheating of the windings caused by the high current flow therethrough that was not de-energized by successful operation of the starter mechanism.

Figure 3:
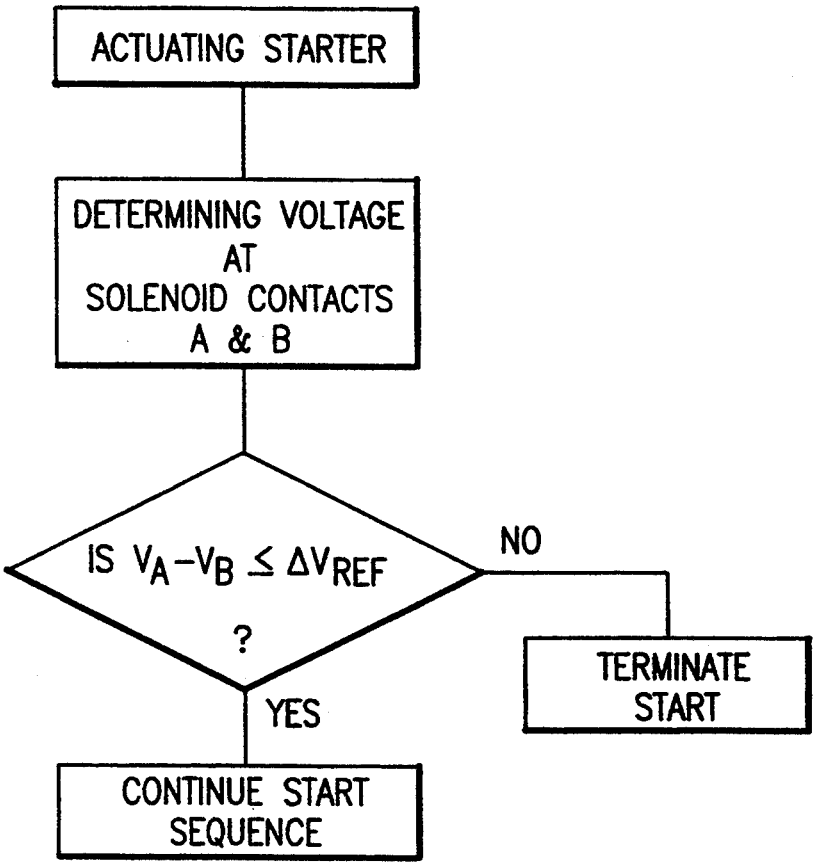
FIG. 3 is a flow chart showing the logic programmed into the microprocessor of the controller of the present invention.

According to the present invention the microprocessor controller 82 is programmed to monitor the voltage at points A and B, i.e. the first and second movable contacts 50, 52. The logic programmed into the microprocessor to accomplish this is illustrated schematically in FIG. 3. During a normal start sequence, when the starter solenoid 35 is energized, the connection path between points A and B will be established shortly after engagement of the starter solenoid. Under such circumstances the voltage at points A and B will be nearly identical. The microprocessor controller is programmed to calculate the difference between the voltage at A and B and compare it to a reference voltage differential, which may be zero, ($\Delta V_{REF}$). If the calculated voltage differential is less than or equal to the predetermined reference voltage differential the starter will continue to operate in its normal operating sequence. If however, this comparison indicates that the voltage differential is not within the above-described range the controller will generate a signal through lead 81 to the starter protection switch 80 to thereby interrupt the application of power to the starter solenoid thus preventing failure of the attracting coil 62 and potentially the entire starter motor 10.

It should be appreciated that while the system is shown with the starter protective switch 80 on the negative side of the starter relay 68 that the switch could readily be installed on the positive side of the starter relay coil.

While the invention has been described in conjunction with a specific embodiment thereof, it is to be understood that such showing is merely illustrative and that changes may be made without departing from the spirit and scope of the invention as claimed.

What is claimed is:

1. A starter for an internal combustion engine having a ring gear, the starter including:

a starter switch, operable between an open and closed condition, adapted to be electrically connected to an electrical power source;

a pinion adapted to be axially movable into and out of meshing engagement with the ring gear;

a plunger for moving said pinion toward said ring gear and having a movable contact at one end thereof;

first and second stationary contacts both so positioned as to be contacted by said movable contact, said first stationary contact being electrically connected to said electrical power source;

exciting coil means for moving said plunger toward first and second stationary contacts, said exciting coil means comprising a holding coil and an attracting coil, said holding and attracting coils having windings electrically connected in series with one other and having a connection coupled thereto at respective one ends of said holding and attracting coils;

a relay including; (a) a pair of normally open contacts connected in series to said electrical power source and said connection coupling said windings of said holding and attracting coils, and, (b) a relay coil electrically connected in series to said starter switch and the other end of said holding coil, and which is energized when said starter switch is turned on, to thereby close said normally open contacts;

a starter motor, said starter motor being drivingly connected to said pinion;

means for electrically connecting said second stationary contact to said starter motor when said starter switch is closed, whereby, when said first movable contact is moved into contact with said first and second stationary contacts to electrically connect them together, said starter motor will be energized by said electrical power source;

a motor controller comprising:

means for determining the voltage at said first stationary contact;

means for determining the voltage at said second stationary contact;

means for calculating the voltage difference between said first stationary contact and said second stationary contact;

means for comparing said calculated voltage difference to a predetermined reference voltage differential, and, if the calculated voltage differential is not less than or equal to said predetermined reference voltage differential interrupting the power supply to said relay coil.

2. The apparatus of claim 1 wherein said motor controller comprises a programmable microprocessor.

3. The apparatus of claim 2 further including: a switch, electrically operable between a conducting and non-conducting condition located in the circuit supplying said relay coil; and wherein said controller generates a signal to open said electrically operable switch to interrupt the power supply to said relay coil.

* * * * *